US006841774B1

(12) United States Patent
Weiss

(10) Patent No.: US 6,841,774 B1
(45) Date of Patent: Jan. 11, 2005

(54) SAMPLE INTRODUCTION DEVICE FOR MASS SPECTROMETRY USING A FAST FLUIDIC SYSTEM TO SYNCHRONIZE MULTIPLE PARALLEL LIQUID SAMPLE STREAMS

(75) Inventor: Adam Weiss, Pickering (CA)

(73) Assignee: MDS Inc., Concord (CA)

( * ) Notice: Subject to any disclaimer, the term of this patent is extended or adjusted under 35 U.S.C. 154(b) by 29 days.

(21) Appl. No.: 10/432,965

(22) PCT Filed: Nov. 28, 2001

(86) PCT No.: PCT/CA01/01673

§ 371 (c)(1),
(2), (4) Date: Oct. 23, 2003

(87) PCT Pub. No.: WO02/44684

PCT Pub. Date: Jun. 6, 2002

Related U.S. Application Data

(60) Provisional application No. 60/270,067, filed on Feb. 20, 2001, and provisional application No. 60/253,616, filed on Nov. 28, 2000.

(51) Int. Cl.[7] ..... H01J 49/26

(52) U.S. Cl. ..... 250/288; 250/428; 250/430

(58) Field of Search ..... 250/288, 281, 250/282; 210/198.2, 656, 243; 356/36

(56) References Cited

U.S. PATENT DOCUMENTS 5,872,010 A 2/1999 Karger et al.
6,066,848 A 5/2000 Kassel et al.
6,207,955 B1 * 3/2001 Wells et al. ..... 250/288
6,501,073 B1 * 12/2002 Mylchreest et al. ..... 250/288
6,635,173 B2 * 10/2003 Brann ..... 210/198.2
2002/0190204 A1 * 12/2002 Hofstadler et al. ..... 250/288
2004/0026617 A1 * 2/2004 Gregori et al. ..... 250/288

FOREIGN PATENT DOCUMENTS

EP 0 169 469 A 1/1986
EP 0 886 143 A 12/1998

* cited by examiner

*Primary Examiner*—Nikita Wells
*Assistant Examiner*—Johnnie L Smith, II
(74) *Attorney, Agent, or Firm*—Baker & Daniels

(57) ABSTRACT

A sample introduction device for introducing a plurality of independent fluid sample streams into a mass spectrometer includes a manifold (84) having a plurality of fluid sample stream direct paths. Each direct path extends between a fluid sample stream inlet (80, 82) and a fluid sample stream outlet. A plurality of bypass paths (92, 96) is also provided in the manifold. Each bypass path is coupled to a respective one of the direct paths between the inlet and outlet. A plurality of transfer lines (86, 94) is also provided with each transfer line being coupled to a respective one of the outlets to deliver a fluid sample stream to an ionization region of the mass spectrometer. A valve (90, 96) is positioned in each of the bypass paths and is actuable to divert the fluid sample stream entering the direct path via the inlet from the direct path and into the bypass path.

28 Claims, 6 Drawing Sheets

FIG. 5

Table 1A

50 μm I.D.

| Flow (μL/min | psi | Transit Time in millisec |
|---|---|---|
| 50 | 80 | 232 |
| 125 | 190 | 96 |
| 250 | 380 | 48 |
| 500 | 740 | 24 |
| 750 | 1100 | 18 |
| 1000 | 1450 | 1 |

(100 μm I.D.

| Flow (μL/min | psi | Transit Time in millisec |
|---|---|---|
| 250 | 30 | 184 |
| 500 | 55 | 92 |
| 750 | 83 | 72 |
| 1000 | 111 | 48 |
| 1500 | 165 | 36 |
| 2000 | 222 | 24 |

Table 1B

50μm I.D.

| Flow (μL/min | psi | Transit Time in millisec |
|---|---|---|
| 50 | 80 | 2.32 |
| 125 | 190 | 0.96 |
| 250 | 380 | 0.48 |
| 500 | 740 | 0.24 |
| 750 | 1100 | 0.18 |
| 1000 | 1450 | 0.01 |

100μm I.D.

| Flow (μL/min | psi | Transit Time in millisec |
|---|---|---|
| 250 | 30 | 1.84 |
| 500 | 55 | 0.92 |
| 750 | 83 | 0.72 |
| 1000 | 111 | 0.48 |
| 1500 | 165 | 0.36 |
| 2000 | 222 | 0.24 |

SAMPLE INTRODUCTION DEVICE FOR MASS SPECTROMETRY USING A FAST FLUIDIC SYSTEM TO SYNCHRONIZE MULTIPLE PARALLEL LIQUID SAMPLE STREAMS

TECHNICAL FIELD

The present invention relates to a sample introduction device and method for rapidly introducing a plurality of samples simultaneously into a mass spectrometer for analysis. Each of the samples is dissolved in a flowing liquid stream. Multiple parallel streams of samples are rapidly and sequentially pulsed into the ionizing region of the mass spectrometer with a system of fast fluidic valves.

BACKGROUND ART

Mass spectrometers have become one of the most widely utilized instruments for analyzing chemical entities dissolved in liquids. As a consequence of the valuable information derived from such analyses, there is an incentive to process increased numbers of samples in shorter periods of time in industrial, academic, and government-based laboratories. High speed serial systems as well as systems capable of introducing multiple samples simultaneously introduced into a mass spectrometer in a parallel fashion have been reported.

The high-speed fast serial approach does not attempt to parallel sample introduction streams. Instead, it assures that samples enter the mass spectrometer in a sequential fashion. The mass spectrometric measurement on each sample remains uninterrupted as the sample enters and passes through the mass spectrometer. The fast serial technique conducts both sample introduction and measurement in a sequential manner as rapidly as fluid transfer constraints will allow. However, they are always constrained by the relatively slow time scale of sequential rather than parallel sample introduction. Some examples of this approach have been published in the literature (Hiller, et al. Rapid Comm. Mass Spectrom. 14, 2034–2038, 2000). Occasionally multiple sprayer systems are incorporated into fast serial introduction systems (see above reference) to ameliorate some of the fluidic delays encountered in single channel sprayers but they are still operated in a serial sample introduction mode with similar time constraints.

There are three general categories of methods for the introduction of multiple samples simultaneously into a mass spectrometer in a parallel fashion. All of the methods share one feature in common, resulting from the fact that the process of obtaining a mass spectrometric measurement on a sample is very fast, typically milliseconds, compared to the rate at which samples can be introduced into the ionization region of the mass spectrometer, typically seconds. Thus, in situations where a plurality of samples are simultaneously entering a mass spectrometer over a relatively long period of time, a series of fast sequential mass spectrometric measurements can be made on each of the multiple samples entering the spectrometer. Although multiple samples enter the mass spectrometer, all of the samples must enter through separate and distinct fluid channels so that each channel may be rapidly turned on and off, by some means, in synchrony with the mass spectrometric measurement. In this way, every mass spectrometric measurement may be associated with a particular sample from a particular channel in an unequivocal fashion.

The three general categories of methods for introducing multiple parallel samples are similar in that the mass spectrometric measurements are taken in rapid sequence, i.e. sequentially. However, from a sample introduction point of view, they are all parallel in nature. Since mass spectrometric measurements are very fast relative to sample introduction speeds (milliseconds versus seconds), the sample introduction becomes the bottleneck for fast analyses, so the sequential mass spectrometric measurements do not negate the speed advantage afforded by parallel sample introduction systems. With parallel systems, the mass spectrometric measurement on each sample is constantly interrupted as the system rapidly cycles from channel to channel. This requires good synchronization between the channel selection and the mass spectrometric measurement so that the data can be easily interpreted without ambiguity regarding the association of a particular measurement and the sample travelling in the selected channel.

The three categories of methods to multiplex sample introduction differ in the means by which they gate i.e. turn on and off, the separate sample channels and thus obtain synchrony with the mass spectrometer. The first method segregates each separate channel into a distinct ion beam within the vacuum system of the mass spectrometer, and deflects or focuses the ion beam at the appropriate time. The second method uses a physical shutter driven by a rotating device such as a stepper motor or other mechanical device to physically block the ionization spray occurring at atmospheric pressure. A derivative of this method physically moves individual sprayers into focus also using a rotating device. The third method is generally referred to as fluidic selector. Each of these approaches are illustrated and discussed in further detail below.

Although the above-described methods permit the introduction of parallel fluidic streams into the mass spectrometer, problems exist in that the gating elements used to select sample channels cause dispersion in the fluid sample streams. As will be appreciated, improvements in the manner by which fluid sample streams are delivered to a mass spectrometer are desired.

It is therefore an object of the present invention to provide a novel sample introduction device and method for introducing one or more fluid sample streams into a mass spectrometer.

DISCLOSURE OF THE INVENTION

Accordingly, in one aspect of the present invention there is provided a sample introduction device for introducing one or more independent fluid sample streams into a mass spectrometer, said sample introduction device comprising:

- a valve located outside a direct path of fluid sample stream to the mass spectrometer, said valve being actuable between open and closed conditions to divert the fluid sample stream either toward or away from said mass spectrometer; and
- one or more ionizing elements to charge the sample emitting from each fluid sample stream into the mass spectrometer.

Preferably, a plurality of independent fluid sample streams is introduced to the mass spectrometer. In this case, the sample introduction device includes a valve associated with each independent fluid sample stream. The valves are actuated so that at least one fluid sample stream is directed to the mass spectrometer and so that other fluid sample streams are diverted away from the mass spectrometer. Each valve includes a valve gate moveable between open and closed positions. The valve gate is positioned so that the valve gate is not in the direct path of the fluid sample stream during transit to the mass spectrometer.

It is also preferred that the opening and closing of the valves is performed in response to a synchronous mass spectrometer data acquisition event. The opening of one valve may be timed with turning off of other valves to reduce channel-to-channel dead time.

Preferably, closing of a valve allows the fluid sample stream to flow along the direct path toward the mass spectrometer while opening of the valve diverts the fluid sample stream into a bypass port away from the mass spectrometer. Flow of the fluid sample stream into the by-pass port may be assisted by vacuum applied to the bypass port. Alternatively, the diameter of the direct path to the mass spectrometer may be less than the diameter of the bypass port, so that opening of the valve automatically diverts the fluid sample stream away from the mass spectrometer.

In one embodiment, each of the fluid sample streams is directed to the mass spectrometer via a transfer line. The transfer lines are arranged in a bundle that is surrounded by a nebulizer tube. The nebulizer tube may contain an additional conduit for purposes other than the transmission of a fluid sample stream such as for example the transport of laser radiation.

According to another aspect of the present invention there is provided a sample introduction device for introducing a plurality of independent fluid sample streams into a mass spectrometer, said sample introduction device comprising:

a manifold having a plurality of fluid sample stream direct paths, each direct path extending between a fluid sample stream inlet and a fluid sample stream outlet, and a plurality of bypass paths, each bypass path being coupled to a respective one of said direct paths between said inlet and outlet;

a plurality of transfer lines, each transfer line being coupled to a respective one of said outlets to deliver a fluid sample stream to an ionization region of said mass spectrometer, and a plurality of valves, each valve being positioned in a respective one of said bypass paths and being actuable to divert the fluid sample stream entering said direct path via said inlet from said direct path and into said bypass path.

According to another aspect of the present invention there is provided a method of analyzing a plurality of samples comprising of the following steps:

(1) injecting samples into separate inlet sample streams of the mass spectrometer;

(2) allowing one sample stream to flow to the mass spectrometer by closing a by-pass valve and diverting all other sample streams into a by-pass by opening by-pass valves;

(3) opening the bypass valve for the one sample stream and closing a bypass valve for a second sample stream, so that the second sample stream flows to the mass spectrometer;

(4) repeating step (3) so that each of said sample streams flows to the mass spectrometer with the other sample streams being diverted into said bypass; and (5) synchronizing mass spectrometric analysis of each sample stream with respect to the opening and closing of the bypass valves.

The present invention provides an advantage over other fluidic selectors in that the valves used to gate the fluid sample streams are located outside of the sample path as it traverses from the injector to the mass spectrometer. Thus, dispersion effects from valve are significantly reduced or eliminated, thereby circumventing the most serious time delay problem associated with other fluidic selectors. In addition, the transit time of the sample through the channel from the signal off/signal on position is reduced to a minimum without resorting to micromachining or miniturized fluidic systems. This is due to the fact that the positions of the valves have no bearing on the distance the fluid travels between the signal on/off points. The end result is much faster cycle times without valve-related dispersion and channel related transit time delays. It also provides independent and random access to each channel, unlike the rotating member spray and fluid selectors.

BRIEF DESCRIPTION OF THE DRAWINGS

Embodiments of the present invention will now be described more fully with reference to the accompanying drawings, in which:

FIG. 5 are tables of calculated pressures and transit times for a length of channel, at different diameters.

BEST MODE FOR CARRYING OUT THE INVENTION

Figures 1A, 1B, 1C:
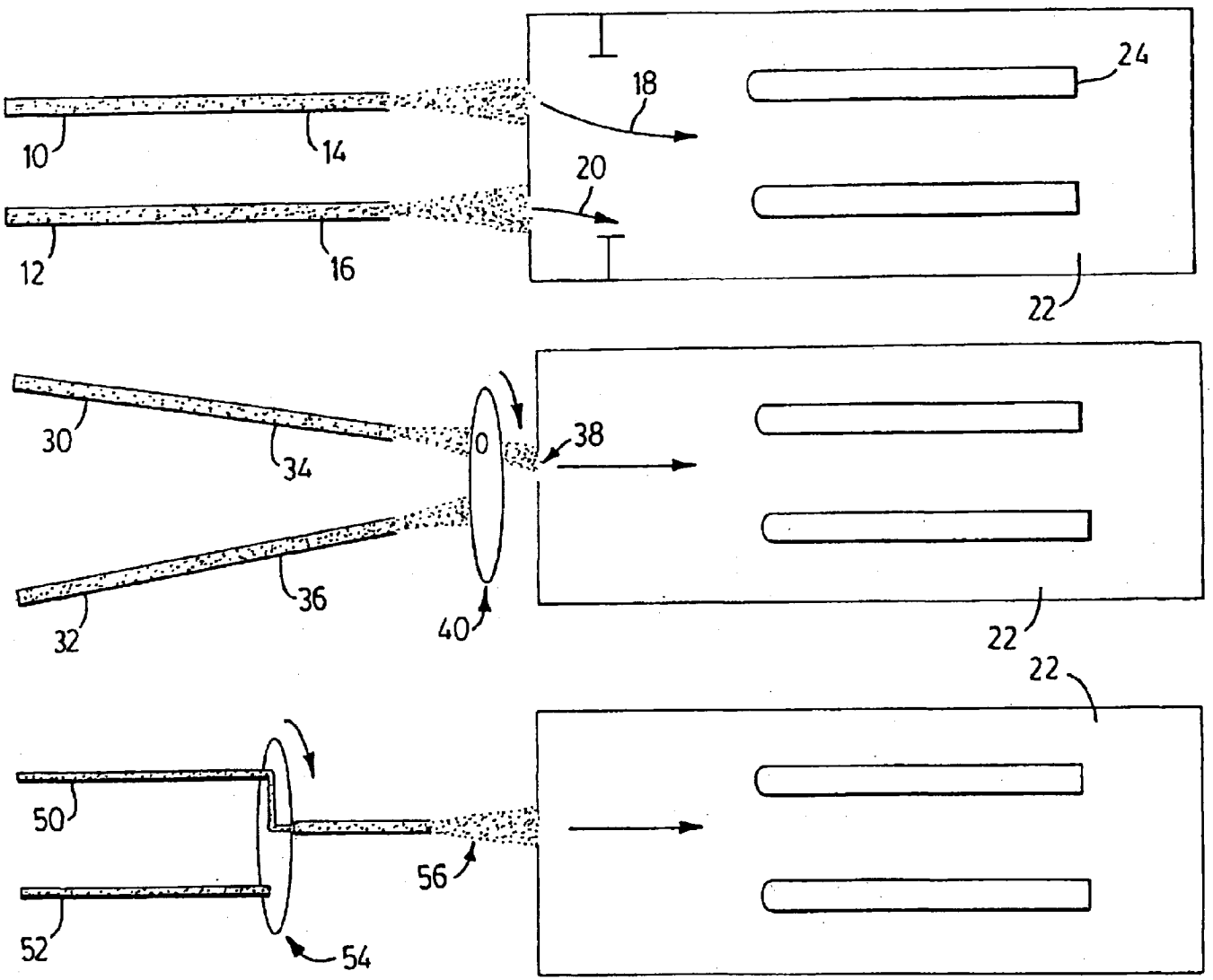
FIG. 1A is a schematic representation of a prior art ion beam selector apparatus for introducing samples into a mass spectrometer.
FIG. 1B is a schematic representation of a prior art spray selector apparatus for introducing samples into a mass spectrometer.
FIG. 1C is a schematic representation of a prior art fluid selector apparatus for introducing samples into a mass spectrometer.

For ease of understanding, prior art devices for introducing multiple samples simultaneously into a mass spectrometer in a parallel fashion will firstly be described with reference to FIGS. 1A to 1C. Turning now to FIG. 1A, an ion beam selector apparatus for introducing samples into a mass spectrometer is shown. As can be seen, ion beam selector apparatus toggles the separate channels 10 and 12 of samples by segregating each separate channel. Each channel is passed through an ionizer, 14 and 16, respectively, to form distinct ion beams 18 and 20, respectively, that enter a vacuum system chamber 22 of the mass spectrometer. Ion beams 18 and 20 are deflected within vacuum system chamber 22 and fed to a mass analyzer 24.

As will be appreciated, this approach requires multiple nebulizing and ionizing sprayers, all producing ions simultaneously. Each sprayer is situated in front of multiple ion entrance apertures to the mass spectrometer. The technique suffers from the potential for fluid overload in the ion source region resulting from all introduction of streams flowing and ionizing at all times. Thus, flow rates per channel are limited. Another drawback is the requirement for multiple ion entrance apertures resulting in either vacuum degradation due to excessive gas loads or a significant sensitivity loss resulting from a reduction in the ion entrance aperture diameters to reduce the gas load to the mass spectrometer. In addition, different sprayers for different channels invariably tend to result in different response factors.

FIG. 1B illustrates a spray selector apparatus for introducing samples into a mass spectrometer. As can be seen, multiple fluid channels 30 and 32 feed multiple ionizing sprayers 34 and 36. In this case, however, only a single ion entrance aperture 38 to the mass spectrometer is required, as on a conventional mass spectrometer. The sprayed charged droplets are gated in the atmospheric region between the sprayer and the ion entrance aperture, by a rotating shutter 40. A derivative of this is to rotate individual prayers into focus in front of the ion entrance aperture, all of the above herein referred to as rotating member devices.

This technique also suffers from the potential for fluid overload in the ion source region since all streams are flowing and ionizing simultaneously, thereby limiting liquid flow rates per channel. Also, the presence of a rapidly rotating member in front of the nebulized and ionized spray enhances the residence time of stray charged droplets circulating around the ion source, which generates cross channel memory effects, especially at higher liquid flows. Multiple sprayers result in different response factors for the different channels and, invariably, multiple sprayer systems spraying at a single ion entrance aperture compromise sensitivity, compared to a single sprayer system, because of interference effects between the sprayers.

Other known methods of turning individual sprayers on and off, such as toggling the high voltage on each sprayer, which is required to charge and ionize the droplets, also fall into this category of spray selectors. High voltage switching, combined with the inherent hysteresis associated with the electrochemical processes involved in the liquid charging process, proves to be too slow for this parallel sampling process.

In all cases, the stream selector approaches have liquid emitting out of all channels at all times. When used with rotating members, a further limitation of this approach is that it is inherently a sequential system whereby channels must be accessed one after the other with fixed dead time between channel selections determined by the stepper motor speed. As a result, these stream selectors do not allow for multiple channels to be simultaneously on while others are cycling, do not allow for random access to channels, nor do they provide flexibility to allow for variable control of the timing of channel actuation in order to reduce between channel dead time by overlapping the turning off of one channel and turning on of another.

By independently controlling shutters or sprayer positions with multiple mechanical devices, the inherent disadvantages of sequential operation imposed by rotating systems can be circumvented. However this is mechanically complex and therefore, is not a popular stream selector approach.

Turning now to FIG. 1C, a fluid selector apparatus for introducing samples into a mass spectrometer is shown. As can be seen, multiple fluidic streams 50, 52 are gated upstream and into a single sprayer by a fluidic valve mechanism 54. Rapid selection of individual fluid streams in synchrony with the mass spectrometric measurement allows injection of a plurality of samples 56 simultaneously and the obtaining of mass spectrometric measurements on all samples as they pass through the ion source. In the example shown, the fluidic valve mechanism includes a rotating stream selector valve that allows multiple channel inlets into the valve to be sequentially diverted into a common channel to the ionizing sprayer of the mass spectrometer.

One of the advantages of this general approach is the use of a single ionizing sprayer for all channels, resulting in identical response factors from all channels and uncompromised sensitivity, a problem observed with multiple sprayer systems. The disadvantage of this general approach, however is manifested in the time delays experienced during the transit of the sample through the valve to the ionizing sprayer, i.e. delays in the rise time of the signal from a particular channel. This adds dead time and ultimately slows the rate at which one can cycle through the channels. Likewise, time delays occur that limit how quickly a channel can be turned off, effectively contributing to excessive cross channel carry-over or cross channel signal contamination. These time delays are in part a result of finite stepper motor actuation times, in part due to a finite travel time of fluids through a tube, but are primarily dominated by non-linear fluidic dispersion effects viz. parabolic flow versus laminar flow, occurring in the channels of the valve and the transfer tube from valve to sprayer.

Fluidic selectors that utilize a rotating stream selector valve also suffer from a similar limitation to the spray selectors, i.e. they are inherently sequential systems whereby channels must be accessed one after the other with fixed dead time between channel actuations determined by the stepper motor speed, fluid transfer, and dispersion effects. As with the rotating member spray selectors, these fluid selectors do not allow for multiple channels to be simultaneously on while others are cycling and do not allow for random access to channels, nor do they provide flexibility to allow for variable control of the timing of channel actuation in order to reduce between channel dead time by overlapping the turning off of one channel with the turning on of another. Because of these problems and disadvantages there have been no reports of a fluid selector approach being adapted for the purpose of parallel sample introduction and synchronization with the mass spectrometer. Rotating member stream selectors are, however, commonly implemented in fast serial sample introduction systems where speed requirements are not nearly as critical as they are for the parallel systems.

Examples of systems for the parallel introduction of samples into mass spectrometers are given in U.S. Pat. No. 6,066,848 of Kassel et al, WO 99/50667 of Hindsgaul et al and EP 0 966 022 of Bateman. A recent publication highlights application of the spray selector approach (Baylis, et. al., Rapid Commun. Mass Spectrom. 14, 2039–2045, 2000.

The present invention provides a sample introduction device that utilizes an array of fast solenoid valves to rapidly and sequentially gate, for ionization, a plurality of liquid sample streams, all simultaneously being fed to a mass spectrometer. The device is believed to be applicable to any mass spectrometer that accepts liquid streams into the ion source region of the mass spectrometer, such as electrospray, atmospheric pressure chemical ionization, and other types of mass spectrometers. Multiple liquid streams containing samples destined for analysis are simultaneously fed into the mass spectrometer. The array of solenoids rapidly and sequentially gates each stream into the ionizing region of the mass spectrometer for analysis. Thus, the samples are analyzed by the mass spectrometer independently of one another in a rapid sequential manner, thereby increasing instrument productivity and throughput. The system is also capable of introducing multiple sample streams into the mass spectrometer without gating such that one or more streams are always flowing and mixing with each other. The system is also capable of pulsing a single sample stream into a mass spectrometer in synchrony with the mass spectrometer or some other device.

The present device has one or more fluid lines delivering samples dissolved in continuously flowing streams. The number of lines may be one, preferably greater than one and typically 4 to 8. The sample in each line passes over a by-pass port in transit to a transfer line that transports the sample to the ionizing region of the mass spectrometer, where ionization and mass spectrometric analysis takes place. The transfer of the sample to the ionizing region can be rapidly turned on and off by the action of a valve located close to or directly on the by-pass port. The by-pass port is maintained at a lower pressure than the transfer line to the mass spectrometer. When the valve opens, the sample diverts through the by-pass port to a by-pass line, due to a backpressure difference between the by-pass port and the transfer line. Applying a slight vacuum to the by-pass port further enhances the pressure differential between the two lines and can increase the speed of the shut-off cycle. Closing the valve, which shuts off the by-pass line, rapidly turns on the transfer of sample to the mass spectrometer via the transfer line.

The present sample introduction device provides a separate valve, by-pass line, and sample transfer line for each inlet to the mass spectrometer allowing each line to be independently controlled and triggered by some external device, such as the mass spectrometer, to provide synchronization. The by-pass port and valve are preferably arranged as a UT fitting.

Using the above-described arrangement of solenoid valves permits the transfer of sample from point of origin to the ionizing region of the mass spectrometer without travelling through a valve element, thus avoiding the time delaying dispersion effects of complex and circuitous valve channels. Time delays associated with the transit time of the sample through the transfer line from the by-pass port (or valve in the case of other systems) to the sprayer (signal rise time) and the shutting off of the signal are reduced with this arrangement in a manner not available to other fluid selector systems. To completely turn off the ionizing spray, the liquid in the channel only needs be withdrawn from the ionizing tip by a distance of about 1 mm, which is believed to be the theoretical minimum transit distance any fluidic system must empty to effectively shut off the signal. Constructing a valving element at a distance of 1 mm from a high voltage ionizing tip represents a significant technological challenge that is perhaps only achievable with nanofabrication technology. No such valves having any practical utility for this application have been developed.

With the arrangement of solenoid valves described herein, the liquid is withdrawn from the ionizing tip only to the distance required to turn off the signal. It is not necessary to withdraw the liquid any further. When the valve closes, the liquid quickly reverses direction and returns to the ionizer, which is a very short distance away. This short transit distance also minimizes dispersion effects otherwise referred to as parabolic flow profiles, which contribute significantly to the rise time of the signal to a steady state level when liquids travel through long lengths of tubing. The retraction of the sample a small distance within the tubing assures a very rapid decay or fall time of the signal, thereby reducing channel to channel cross contamination or carry-over.

The advantage of the use of a single ionizing sprayer is maintained with this approach. Multiple channels do not converge to a single channel as described above for other prior art fluidic selectors. In the present invention, multiple channels, arranged in parallel, remain independent for their entire length and converge into a single ionizing element, such as an electrospray or atmospheric pressure chemical ionization nebulizer, in the form of a channel bundle, resembling a fibre optic bundle. Because of this, cross channel contamination due to sample adsorption to the walls of a common channel is reduced or eliminated. In a preferred embodiment, clean solvent brought to the ionizing tip by a separate line will assure no residues are momentarily left on the ends of each sample line to cause cross channel contamination. Such a bundle or array of channels also allows for the introduction of conduits other than sample or solvent channels e.g. optical fibres to transport energy such as IR laser light for the purposes of enhancing the vaporization of the spraying liquid from the sample channels or for simple visualization and tuning of the spray. As an option, each line may be fed to a different ionizing element.

When multiple channels are employed, there are four general modes of operation of the present sample introduction device, as follows:

1. Parallel sample introduction with serial mass spectrometric detection.
2. Serial sample introduction with serial mass spectrometric detection.
3. Parallel sample introduction with parallel mass spectrometric detection.
4. Combination of the above modes such that some channels are operating in one mode while others are operating in another.
5. One mode of operation is excluded, that being serial sample introduction with parallel detection, as physically impossible.

The first method provides a means for simultaneously analysing multiple samples injected in parallel into the mass spectrometer. During this mode of operation each channel is rapidly turned on and off in sequence on a time scale much faster than the time required for any of the samples to pass through and exit the channels. When one valve is shut, the transfer line associated with that particular valve delivers sample to the mass spectrometer. The remaining valves are open diverting the samples, away from the mass spectrometer. The electronics used to drive the valves synchronize the opening and closing of the valves with the mass spectrometric analysis, so that the analytical results from the mass spectrometer may be correlated with the samples. The mass spectrometer collects data during these short bursts of sample introduction and stores the data collected from each channel in a separate location or file, referred to as indexing or indexed operation. This method of operation has the most demanding specifications for speed of channel turn-off and turn-on. Turn-off times of less than 10 milliseconds, providing a reduction of the signal level by 3 orders of magnitude, have been achieved with this technique. Similarly signal rise times of less than 10 milliseconds have been observed under similar conditions. Stepper motor driven spray selectors or fluid selectors have a fundamental limitation dictated by motor speeds, typically 50–100 milliseconds plus additional dead times introduced by other factors.

This method has significant advantages over the rotating member spray and fluid selector systems in being able to achieve further speed enhancements for the indexed mode of operation. As each channel is controlled independently from all others, further reductions in channel-to-channel dead time may be achieved by overlapping in time the turning off of one channel with the turning on of the next. A substantial speed advantage will be accrued, because any residual delays in fluid transfer will be compensated for by this offset in valve actuation time. Such independent control of the channels also allows for any desired sequence of channel selection to be utilized, whereas the rotating member spray and fluidic selectors can only operate in a single fixed sequence.

The second method of operation provides for a superior means of optimising the speed of the fast serial sample introduction approach. Each channel may be operated in a non-indexed fashion, similar to a typical stream selector valve, to gate samples very rapidly but sequentially (as opposed to in parallel) into the mass spectrometer. As the different channel lines remain independent for their entire length, cross channel contamination due to sample adsorption to the walls of a common channel is eliminated. The fast serial sample introduction approach also benefits from the absence of a valving element in the path of the sample as it transits to the mass spectrometer. This reduces severe fluidic dispersion effects that limit the speed of sample transit. Even though speed constraints are considerably relaxed in the fast serial mode of operation compared to the indexed parallel mode, improvements in speed due to reduced wall adsorption with common channels and reduction of sample dispersion effects make this method ideal for fast serial sample gating.

The third method of operation involves both parallel sample introduction and parallel mass spectrometric data acquisition. As the valves may be independently controlled, this method of operation is available. It cannot be achieved with the rotating member spray or fluid selectors. At any time, one or more channels may be continuously left on. The samples will mix in the ionization region of the mass spectrometer and data acquisition will occur simultaneously on all channels. Although it is impossible to distinguish what signals came from what channel in this mode if the composition of the sample is completely blind, it is a useful technique for adding a known calibrant compound to one stream to be used as a reference mass for precise molecular weight calculations of the components in the other stream containing the unknown components.

The fourth method of operation involves any combination of the above three modes occurring simultaneously. The independence of control of each channel provides ultimate flexibility. One or multiple channels may be permanently on or off while any combination of the remaining valves are cycled in an indexed fashion.

The present sample introduction device also provides advantages due to its mechanical simplicity, robustness and inherent reliability. The performance of the sample introduction device is insensitive to small leakage rates of the valves because the valve is outside the sample path in transit to the mass spectrometer. A leakage rate of a few percent can be tolerated i.e. several orders of magnitude worse than typical solenoid valve specifications, with virtually no effect on the rise and fall time of the sample signal and ultimately the achievable speed of cycling without excessive carryover. This translates into an important element of robustness and tolerance to performance degradation. In addition, the mechanical actuation of on/off solenoid valves is at least 10 times faster than stepper or servo motors (sub millisecond versus several tens of milliseconds) used for spray selectors or fluidic selectors of the switching valve type. Also, lifetime and reliability of on/off solenoid valves are 10 times longer than motors and 100 times longer than switching valves.

Figure 2A:
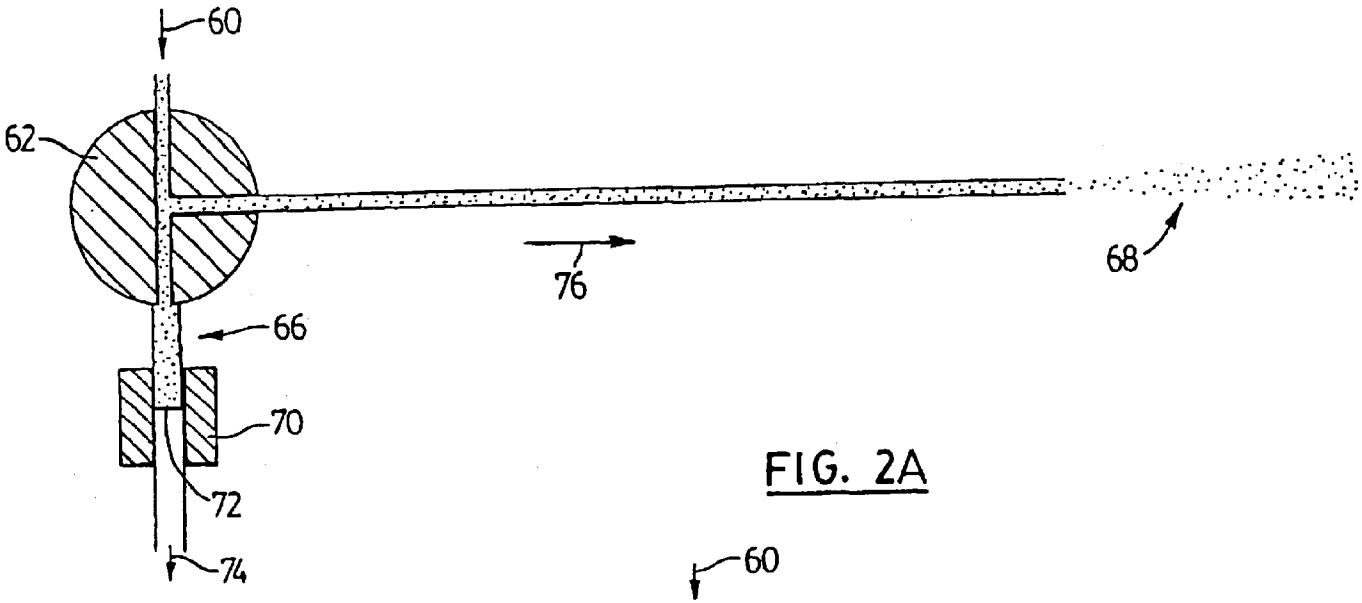
FIGS. 2A and 2B are schematic representations of a single channel fluid introduction device in accordance with the present invention.
Figure 2B:
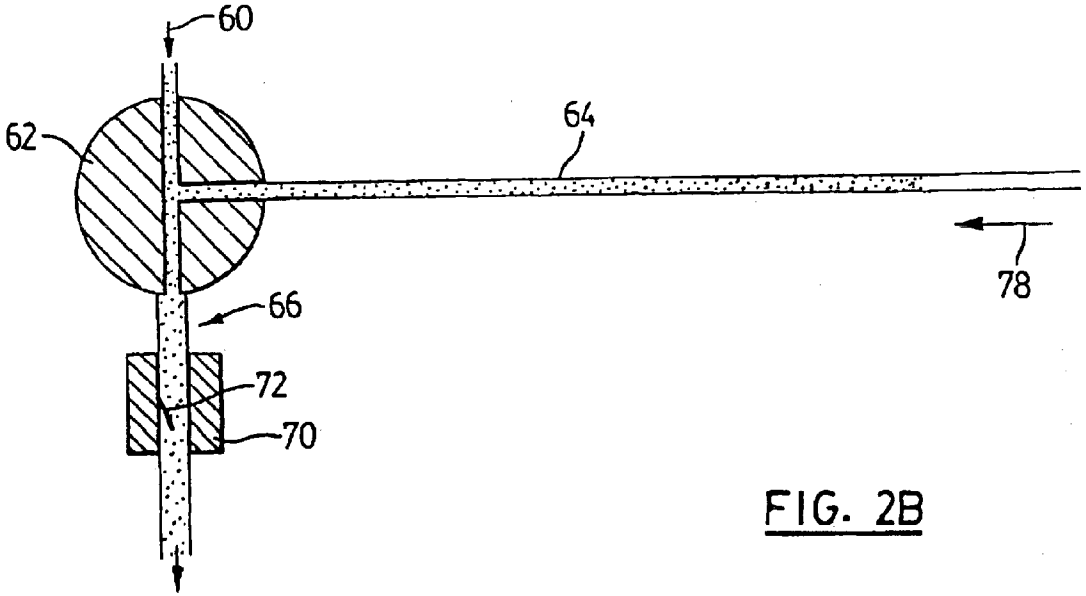

Turning now to FIGS. 2A and 2B, a sample introduction device in accordance with the present invention is illustrated. In this embodiment, the sample introduction device is a single channel device and includes a "T" fitting 62 having an inlet 62 receiving a sample. "T" fitting 62 also has outlets 64 and 66. Outlet 64 is connected to a mass spectrometer (not shown) through ionization region 68. Outlet 66 is connected to a valve 70, which has gate 72 actuable between in a closed position as shown in FIG. 2A and an open condition as shown in FIG. 2B. Valve 70 also has an outlet port 74.

When the gate 72 of the valve 70 is in the closed position as shown in FIG. 2A, a sample entering inlet 60 is forced to pass through ir fitting outlet 64 towards the mass spectrometer as is shown by arrow 76. However, on opening of the valve gate 72, the sample entering inlet 60 passes through 'T' fitting 62 and through valve 72 to outlet port 74. As noted above, the back pressure that is on outlet 64 causes the sample entering inlet 60 to pass through valve 70 when valve gate 72 is in an open position. When valve gate 72 is open, any sample in outlet 64 is forced to flow backwards toward "T" fitting 62, as indicated by arrow 78. Adjustment of the vacuum applied to outlet port 74 controls the distance the fluid flows backwards. This distance can be minimized with this control function. Alternatively no vacuum need be used if care is taken to balance the relative backpressures applied by lines 64 and 66. In this particular embodiment, valve 70 is a high-speed solenoid valve, which typically has an actuation time of 5 milliseconds but can be driven at rates as high as 200 microseconds.

With this arrangement it can be seen that the sample, as it traverses to the ionization region 68 of the mass spectrometer, never passes through a valve element nor does the fluid have to completely empty from the transfer line. Thus, the apparatus is not subjected to the fluidic dispersion effects or sample transit time delays typified by stream selecting valves and the like.

It will be noted that outlet 66 is larger than the inner diameter of the fluidic stream at outlet 64. This creates a greater backpressure at outlet 64 than at outlet 66. Consequently, when valve gate 72 is opened, the sample flow is instantly diverted through valve 70. To control the magnitude of the pressure differential between the two lines and thus control the transit distance of the sample from the sprayer tip, a variable and controllable vacuum may be applied at outlet port 74 to allow for this parameter to be tuneable to achieve maximum sample turn on and off rates.

Figure 3:
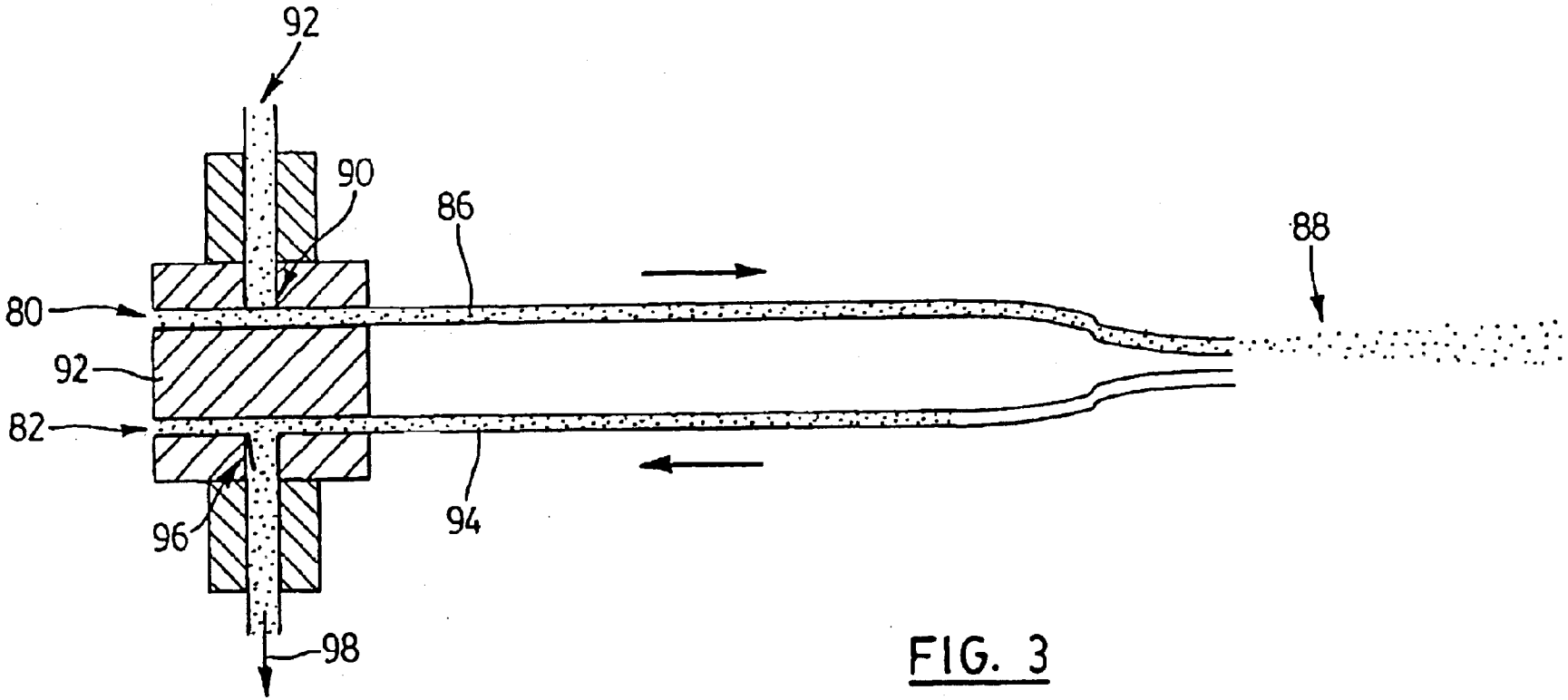
FIG. 3 is a schematic representation of a two-channel fluid introduction device in accordance with the present invention.

Turning now to FIG. 3, another embodiment of a sample introduction device in accordance with the present invention is shown. In this embodiment, sample introduction device includes a manifold 84 receiving two inlet sample streams identified by reference numerals 80 and 82 respectively. Manifold 84 in this case includes two "T" fittings. Inlet 80 is connected to outlet 86 of manifold 84, which is directed through ionization region 88 of a mass spectrometer. Manifold 84 also has a first solenoid valve including a valve gate 90, which connects to outlet 92. In FIG. 3, valve gate 90 is shown in a closed position, so that a sample stream entering inlet 80 passes through outlet 86 to the mass spectrometer via a transfer line. Upon opening of the valve gale 90 however, a sample stream entering inlet 80 is diverted to outlet 92.

Inlet 82 is connected to outlet 94, which is also directed to the ionization region 88 of the mass spectrometer. Manifold 84 additionally has a second solenoid valve including a valve gate 96, which connects to outlet 98. Valve gate 96 is shown in an open position so that a sample stream entering inlet 82 is diverted through outlet 98. Upon closing of the valve gate 96, a sample stream entering inlet 82 however passes through outlet 94 to the ionization region 88 of the mass spectrometer via a transfer line.

In operation, either valve gate 90 or valve gate 96 of manifold 84 is in an open position, with the other valve gate being in a closed position. In FIG. 3, valve gate 90 is shown in a closed position. Thus, a sample entering at inlet 80 passes through manifold 84 to outlet 86 and hence to the mass spectrometer. A sample entering at inlet 82 is diverted through valve gate 96 to outlet 98 due to the fact that the inner diameter of outlet 94 is less than the inner diameter of outlet 98. As soon as valve gate 96 is closed, at which time valve gate 90 is opened, the sample entering inlet 82 passes to the mass spectrometer and the sample entering inlet 80 is diverted to outlet 92. At the onset of operation, it will take a single cycle to completely fill the transfer lines extending from outlets 86 and 94. On subsequent cycles, when the associated valve is opened to shut off the spray from a selected transfer line, the fluid will be retracted only partially if so desired. Minimization of the retraction distance will maximize the speed. This is done by controlling the vacuum on outlets 92 and 98 or by controlling the backpressure of the outlets 92 and 98 relative to the transfer lines extending from the respective outlets 86 and 94 e.g. by use of different inner diameter tubing, needle valves or the like.

In the embodiment of FIG. 3, the solenoid valves are mounted on the manifold 84 in such a way that the valve gates 90 and 96 are very close to the by-pass apertures. This enhances the speed at which the transfer lines extending from outlets 86 and 94 refill when the valves are closed. No additional dispersion effects will be encountered by the close proximity of the valve seat to the fluid lines through which the samples traverse on the way to the mass spectrometer ionization region 88.

The fluidic sample lines 86 and 94 are shown as converging, to allow them to be bundled into a single ionization device. These lines are typically made from fused silica tubing of <200 microns outside diameter and inner diameters ranging from 20–150 microns.

Figure 4:
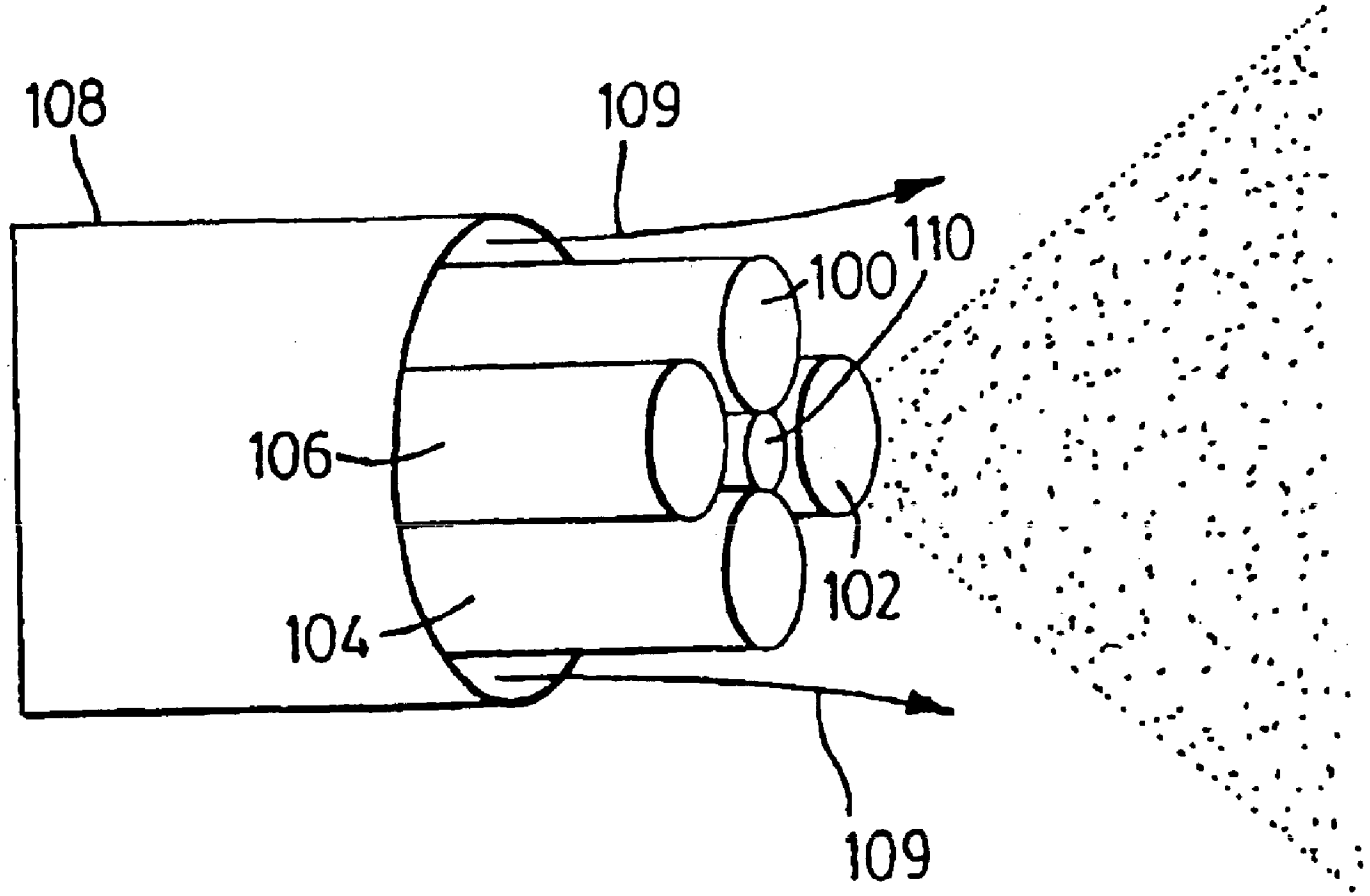
FIG. 4 is a schematic representation of four channels bundled for entry into the same ionizer of a mass spectrometer.

FIG. 4 depicts four separate sample transfer lines 100, 102, 104 and 106 bundled into an electrospray ionizer. Sample transfer line 102 is shown delivering a sample to the mass spectrometer, the other sample transfer lines are shown as being off. A metal nebulizer tube 108 surrounds sample transfer lines 100 to 106. A gas flows at a high velocity through metal nebulizer tube 108, to atomize the liquid passing through the sample transfer lines as indicated by reference numeral 109. This gas is optional and may be avoided if the total liquid flow is sufficiently low to allow for nebulization of the liquid to occur strictly as a consequence of the disruptive power of the electric field. Metal nebulizer tube 108 is maintained at a high voltage to charge the liquid. Voltage contact is made through solvent wash delivered into the electrospay ionizer via a wash tube 110, which is shown as protruding from metal nebulizer tube 108, but in practice is recessed within metal nebulizer tube 108. High voltage contact is made to the solvent wash, which streams over the fluidic sample transfer lines and completes the electrical contact. Other means of making electrical contact to the separate sample transfer lines are also possible including making the channels of metal, by providing a metal junction upstream in the fused silica line from which sample transfer lines are formed, or by simply lowering the gas nebulizer pressure sufficiently to allow the liquid to wick back on the outside of the sample transfer lines and make contact with the metal nebulizer tube 108.

Tube 110 can also serve other functions. Tube 110, for example, can serve as a conduit to transport energy such as IR laser light to enhance the vaporization of the spraying liquid, to introduce photons for sample ionization purposes, to introduce additional gases to enhance the ionization process, or to serve as a simple illumination device to enhance visualization for tuning purposes.

One of the most important functional specifications of any device used to sample multiple sample streams simultaneously entering a mass spectrometer is the speed with which each transfer line or channel can be completely turned off and back on. This defines the duty cycle or more precisely the frequency at which all channels of a system can be sampled as well as the cross channel carry-over at any particular frequency. The most common means of introducing samples in liquid streams into a mass spectrometer is through a high performance liquid chromatograph, which typically presents samples to the mass spectrometer in plugs of several seconds wide. This means that for a multiplexing device to be useful, it should be able to cycle through all channels at a rate of greater than 1 Hz, preferably much faster. Each channel must then be able to turn on and off in no more than a maximum of 100 milliseconds and preferably much faster than this to allow for sufficient time to acquire mass spectrometric data on each channel. 1.0 [054] For a fluidic selector of the present type, the rate at which a channel is turned off is very fast, because the liquid needs only to retract from the ionizer tip by 1–2 mm to shut off ionization. The rate at which a channel can be turned on is determined by the transit or refill time of the fluid in the transfer line from the "T" fitting to the ionizer tip. The velocity of the liquid through the transfer line is the major determinant of this time delay together with dispersion effects of the sample in the solvent. As discussed above, the dispersion effects are minimized in the sample introduction device of the present invention. The velocities may be considered to be a function of the volumetric flow of liquid delivered to the tube, the tube inner diameter, and the length. Assuming fluids are essentially non-compressible, the rate at which the fluid accelerates to the calculated terminal velocity is very fast at the pressures commonly contained by solenoid valves, typically less than 2000 psi.

Table 1A in FIG. 5 indicates a scenario wherein the 10 cm long fluid transfer line from the sprayer to the valve gate is completely emptied on each cycle, which may be referred to as a worst case scenario. Calculated transit times are shown for fluids in a 10 cm length of fused silica tubing of two different inner diameters viz. 50 and 100 microns. The calculated transit times indicate that sufficient speed is available to allow for a liquid flow rate range of 125 to 2000 microliters/minute with tubes of 50 and 100 micron internal diameters. This is the typical operational flow rate range of high performance liquid chromatography, the most common means of fluid sample introduction into mass spectrometers. Fused silica tubing is understood to be available with inner diameters from two microns to several hundred microns, thus extending the usable flow range considerably.

Table 1B indicates a preferred scenario where, with proper tuning of the backpressure with vacuum or other means, the transfer line empties only the required distance to shut off the spray. Since the velocity relationships are linear, a speed enhancement of 100 fold over the case described in Table 1A is achieved.

Figure 6:
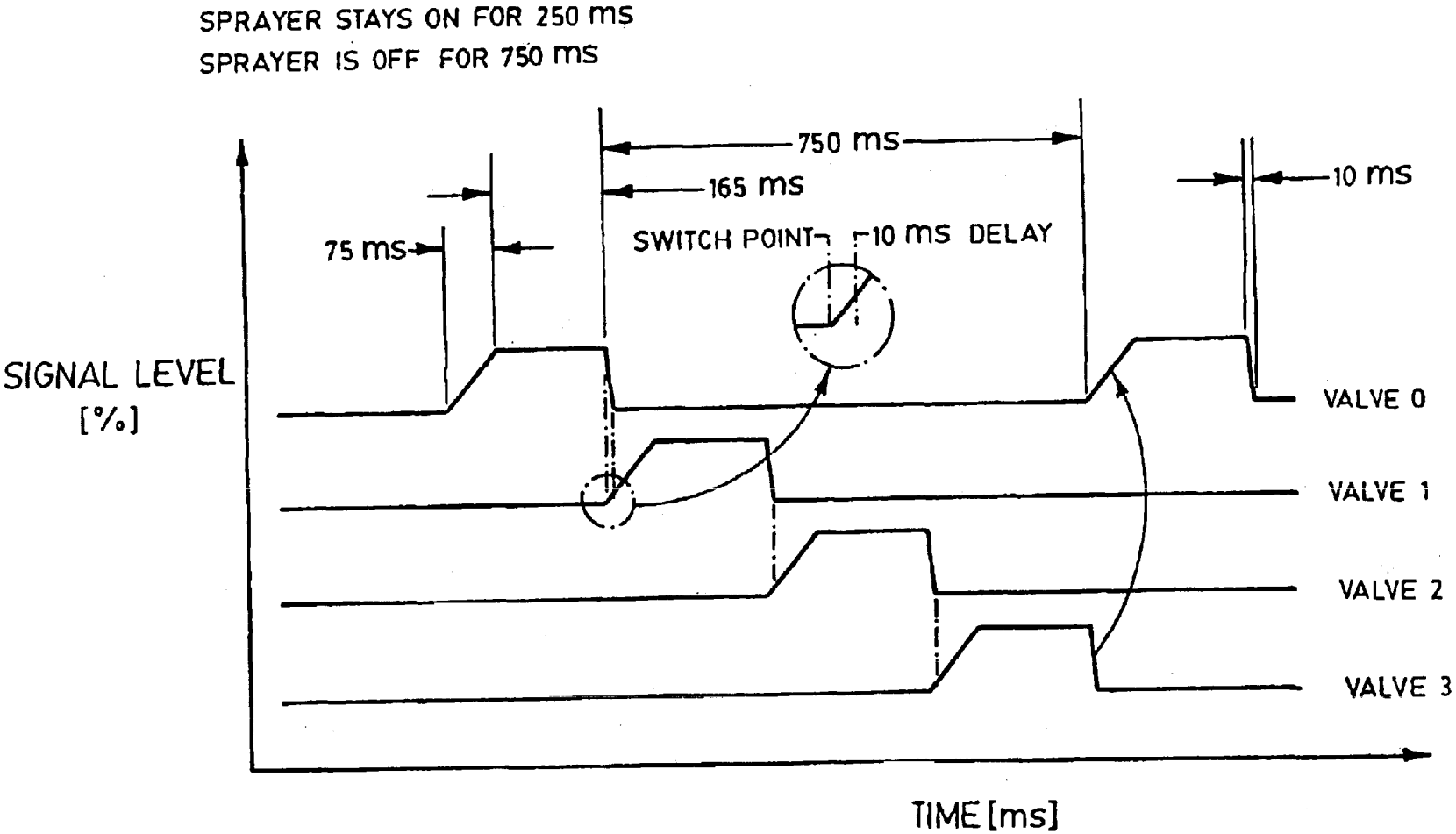
FIG. 6 is a schematic representation of cycling of valves for infusion of a substance, with four sprayers.

FIG. 6 shows data, obtained using ultraviolet absorbance detection at 254 nm, that demonstrates that the calculated speeds are within a reasonable measure of experimental error. A sample of caffeine was pumped through a four-channel sample introduction device at a rate of 1000 microliters per minute. UV detection was accomplished by utilizing the last 1 millimetre at the tip of the fused silica sample transfer line as the detection cell. The total length of this transfer line was 11 cm and the inner diameter 100 microns. The rise and fall times of the signals were measured on all four valves when operating at the targeted cycling frequency of 1 Hz. Vacuum was applied to the outlet of the "T" fitting sufficient to assure that the transfer line was emptied up to the by-pass valve gate.

The measured rise times, as seen in the data of FIG. 6, were 75 milliseconds with a rapid shut off time of 10 milliseconds. The calculated rise time (transit time) is 52 milliseconds; this discrepancy is believed to be accounted for as a result of some dispersion effects, due to fluid interactions with the walls of the tube. It is believed that the correlation between calculation and experimental data is sufficiently close to indicate that the requisite speeds are available from this fluidic device to provide an efficient multi-channel sampling system for parallel fluidic sample introduction into a mass spectrometer.

In a typical operation of the sample introduction device in accordance with the present invention, multiple samples are fed in separate transfer lines into a mass spectrometer. The valves for each separate line would be set in open or shut positions. At any one time, one valve would be closed so that the particular sample is fed to the ionizing region of the mass spectrometer and all other valves would be open so that all remaining samples would be by-passed and not fed to the ionizing region of the mass spectrometer. The closed valve would then be opened and another valve closed, so that a different sample is fed to the ionizing region. The procedure would then be repeated. In the present invention, the valves may be opened and closed in a rapid manner, so that a rapid sequence of samples may be fed to the ionizing region of the mass spectrometer, with the analysis of samples in the mass spectrometer being coordinated and synchronized with the opening and closing of valves so that the analytical results may be correlated with the respective samples.

An exception to the typical procedure would be when two, or more, samples were to be fed to the ionizing region at the same time e.g. a calibrant stream and the sample to be analyzed.

The present invention offers the advantage over other fluidic selectors in that the valving elements used to gate the sample streams are located outside of the sample path as it traverses from the injector to the mass spectrometer. Thus, dispersion effects from valve elements may be eliminated, avoiding a serious problem that other fluidic selectors encounter. It also provides a means for minimizing the sample transit distance to the theoretical limit required to turn on and off a spray. All the advantages of fluidic selectors over other methods are maintained intact including the ability to produce ionization from a single point source rather than multiple ionizing elements. The present invention also has the advantage of mechanical simplicity and associated robustness required for the 24 hour per day multiple day operations typical of high throughput chemical analyses.

Although preferred embodiments of the present invention have been described, those of skill in the art will appreciate that variations and modifications may be made without departing from the spirit and scope thereof as defined by the appended claims.

What is claimed is:

1. A sample introduction device for introducing one or more independent fluid sample streams into a mass spectrometer, said sample introduction device comprising:

a valve located outside a direct path of fluid sample stream to the mass spectrometer, said valve being actuable between open and closed conditions to divert the fluid sample stream either toward or away from said mass spectrometer; and one or more ionizing elements to charge the sample emitting from each fluid sample stream into the mass spectrometer.

2. A sample introduction device according to claim 1 wherein said valve is opened and closed in synchrony with mass spectrometer data acquisition.

3. A sample introduction device according to claim 1 wherein a plurality of independent fluid sample streams are introduced to said mass spectrometer, said sample introduction device including a valve associated with each independent fluid sample stream.

4. A sample introduction device according to claim 3 wherein said valves are actuated so that at least one fluid sample stream is directed to said mass spectrometer and so that other fluid sample streams are diverted away from said mass spectrometer.

5. A sample introduction device according to claim 4 wherein said valves are actuated to simultaneously transfer two fluid sample streams to the mass spectrometer, other fluid sample streams being diverted away from said mass spectrometer.

6. A sample introduction device according to claim 3 wherein each valve includes a valve gate moveable between open and closed positions, said valve gate being positioned so that said valve gate is not in the direct path of said fluid sample stream during transit to the mass spectrometer.

7. A sample introduction device according to claim 3 wherein said opening and closing of said valves is performed in response to a synchronous mass spectrometer data acquisition event.

8. A sample introduction device according to claim 7 wherein opening of one valve is timed with turning off of other valves to reduce channel-to-channel dead time.

9. A sample introduction device according to claim 8 wherein closing of a valve allows said fluid sample stream to flow along said direct path toward the mass spectrometer.

10. A sample introduction device according to claim 9 wherein opening of a valve diverts the fluid sample stream into a bypass port away from the mass spectrometer.

11. A sample introduction device according to claim 10 wherein flow of said fluid sample stream into said by-pass port is assisted by vacuum applied to said bypass port.

12. A sample introduction device according to claim 10 wherein the diameter of the direct path to the mass spectrometer is less than the diameter of said bypass port, so that opening of the valve automatically diverts the fluid sample stream away from the mass spectrometer.

13. A sample introduction device according to claim 3 wherein each of said fluid sample streams is directed to said mass spectrometer via a transfer line, said transfer lines being arranged in a bundle, said bundle being surrounded by a nebulizer tube.

14. A sample introduction device according to claim 13 further including a conduit within said nebulizer for purposes other than the transmission of a fluid sample stream.

15. A sample introduction device according to claim 14, wherein said conduit is for the transport of laser radiation to aid in the desolvation or irradiation of the spray of fluid sample streams.

16. A sample introduction device according to claim 3 wherein said valves are solenoid valves.

17. A sample introduction device according to claim 16 wherein each of said valves is arranged in a "T" fitting, said "T" fitting having a direct path from a fluid sample stream inlet to a transfer line leading to said mass spectrometer and a bypass path extending from the direct path between said inlet and transfer line, said valve being positioned in said bypass path.

18. A sample introduction device according to claim 17 wherein each valve has a valve gate positioned at the juncture between said by-pass path and said direct path.

19. A sample introduction device for introducing a plurality of independent fluid sample streams into a mass spectrometer, said sample introduction device comprising:

a manifold having a plurality of fluid sample stream direct paths, each direct path extending between a fluid sample stream inlet and a fluid sample stream outlet, and a plurality of bypass paths, each bypass path being coupled to a respective one of said direct paths between said inlet and outlet;

a plurality of transfer lines, each transfer line being coupled to a respective one of said outlets to deliver a fluid sample stream to an ionization region of said mass spectrometer; and a plurality of valves, each valve being positioned in a respective one of said bypass paths and being actuable to divert the fluid sample stream entering said direct path via said inlet from said direct path and into said bypass path.

20. A sample introduction device according to claim 19 wherein each valve includes a valve gate positioned at the juncture between said direct path and said bypass path, said valve gate being actuable from a closed position to an open position thereby to divert the fluid sample stream into said bypass path.

21. A sample introduction device according to claim 20 wherein the diameter of each direct path is less than the diameter of each bypass path.

22. A sample introduction device according to claim 21 wherein flow of a fluid sample stream into a by-pass path is assisted by vacuum applied to said bypass path.

23. A sample introduction device according to claim 21 wherein opening and closing of said valves is performed in response to a synchronous mass spectrometer data acquisition event.

24. A sample introduction device according to claim 23 wherein said transfer lines are arranged in a bundle; said bundle being surrounded by a nebulizer tube.

25. A sample introduction device according to claim 24 further including a conduit within said nebulizer for purposes other than the transmission of a fluid sample stream.

26. A sample introduction device according to claim 25 wherein said conduit is for the transport of laser radiation to aid in the desolvation or irradiation of the spray of fluid sample streams.

27. A sample introduction device according to claim 23 wherein said valves are solenoid valves.

28. A method of analyzing a plurality of samples comprising of the following steps:

(1) injecting samples into separate inlet sample streams of the mass spectrometer;

(2) allowing one sample stream to flow to the mass spectrometer by closing a by-pass valve and diverting all other sample streams into a by-pass by opening by-pass valves;

(3) opening the bypass valve for the one sample stream and closing a bypass valve for a second sample stream, so that the second sample stream flows to the mass spectrometer;

(4) repeating step (3) so that each of said sample streams flows to the mass spectrometer with the other sample streams being diverted into said bypass; and (5) synchronizing mass spectrometric analysis of each sample stream with respect to the opening and closing of the bypass valves.

* * * * *